United States Patent [19]

Katayanagi

[11] Patent Number: 4,789,259

[45] Date of Patent: Dec. 6, 1988

[54] CUT SHEET FEED APPARATUS

[75] Inventor: Jun Katayanagi, Musashino, Japan

[73] Assignee: Canon Kabushiki Kaisha, Tokyo, Japan

[21] Appl. No.: 1,873

[22] Filed: Jan. 9, 1987

[30] Foreign Application Priority Data

| | | | |
|---|---|---|---|
| Jan. 13, 1986 | [JP] | Japan | 61-4866 |
| Jan. 13, 1986 | [JP] | Japan | 61-4867 |
| Apr. 17, 1986 | [JP] | Japan | 61-8997 |

[51] Int. Cl.[4] ..... B41J 11/58; B41J 13/10; G03G 15/00; B65H 5/22

[52] U.S. Cl. ..... 400/624; 271/3; 355/3 SH; 355/14 SH; 400/625

[58] Field of Search ..... 400/624, 625, 629; 271/3, 4, 10; 355/3 SH, 14 SH

[56] References Cited

U.S. PATENT DOCUMENTS

| | | | |
|---|---|---|---|
| 4,212,456 | 7/1980 | Ruenzi | 400/625 X |
| 4,262,894 | 4/1981 | Marano | 271/4 |
| 4,268,021 | 5/1981 | Rutishauser et al. | 271/4 |
| 4,527,172 | 7/1985 | Nagashima et al. | 400/624 X |
| 4,577,849 | 3/1986 | Watanabe | 271/10 X |
| 4,585,224 | 4/1986 | Kuzuya | 400/629 X |
| 4,652,161 | 3/1987 | Crean et al. | 400/625 |

FOREIGN PATENT DOCUMENTS

| | | | |
|---|---|---|---|
| 1060493 | 8/1979 | Canada | 270/52.6 |
| 0179945A1 | 11/1984 | European Pat. Off. . | |
| 2854696C2 | 12/1978 | Fed. Rep. of Germany . | |
| 81336 | 4/1986 | Japan | 271/3 |

*Primary Examiner*—A. T. Grimley
*Assistant Examiner*—Ed Pipala
*Attorney, Agent, or Firm*—Fitzpatrick, Cella, Harper & Scinto

[57] ABSTRACT

A cut sheet feed apparatus in a recording system having recording means for performing recording at a recording position, includes first storing means for storing cut sheets to be fed to the recording position feeding means for feeding the cut sheets from the first storing means to the recording position second storing means for storing cut sheets passing through the recording position discharge means for discharging the cut sheets to the second storing means a reversible drive motor for operating the feeding means and the discharge means; and transmitting means for transmitting a forward rotational force of the drive motor to the feeding means and the discharge means to simultaneously perform feed and discharge operations, and for transmitting a reverse rotational force to the discharge means to release transmission of the rotational force to said feeding means, thereby allowing only the discharge operation.

22 Claims, 4 Drawing Sheets

CUT SHEET FEED APPARATUS

BACKGROUND OF THE INVENTION

1. Field of the Invention

The present invention relates to a cut sheet feed apparatus used in a recording system (or a recording apparatus) having a recording means for performing recording at a recording position.

2. Related Background Art

In a recording apparatus such as a printer, a cut sheet feeder is often used to automatically feed cut sheets to the recording apparatus or discharge them therefrom.

In a conventional cut sheet feeder, one pulse motor (a feeder motor) is mounted to rotate one of a feed and discharge rollers according to the rotational direction of the pulse motor. One-way clutches are arranged in transmission systems of the feed and discharge rollers, and one of the one-way clutches is driven according to the rotational direction of the feeder motor.

With the conventional structure described above, feeding and discharge of cut sheets cannot be simultaneously performed. The next sheet is fed after the previous sheet is completely discharged. The recording operation is therefore interrupted, and a throughput of the recording apparatus is low.

The discharge roller and the sheet feed roller in the recording apparatus are, in general, synchronously rotated.

However, in recent continuous recording, discharge of the previous sheet can be simultaneously performed with feeding of the next cut sheet. When only discharge of the cut sheet is to be performed, only the discharge roller is rotated to increase the throughput of the recording operation.

At any rate, in a recording apparatus such as a printer incorporating a cut sheet feeder, cut sheets are automatically fed and/or discharged. Therefore, a sheet feed roller (i.e., a platen roller) need not be manually rotated.

However, in practice, when a printing position is arbitrarily adjusted, when the power switch is kept off, or when an alarm is generated at the time of paper jam or the like, the sheet must be manually discharged. Demand has thus arisen for manually operating a platen knob (i.e., a knob for pivoting the sheet feed roller) and for simultaneously rotating the discharge roller as well as the sheet feed roller.

SUMMARY OF THE INVENTION

It is an object of the present invention to provide a simple cut sheet feed apparatus capable of suitably feeding cut sheets.

It is another object of the present invention to increase a total recording speed.

It is still another object of the present invention to allow manual discharge of cut sheets.

The above and other objects, features and advantages of the present invention will be apparent from the following detailed description in conjunction with the accompanying drawings.

DETAILED DESCRIPTION OF THE PREFERRED EMBODIMENT

The present invention will be described in detail with reference to the accompanying drawings.

Figure 1:
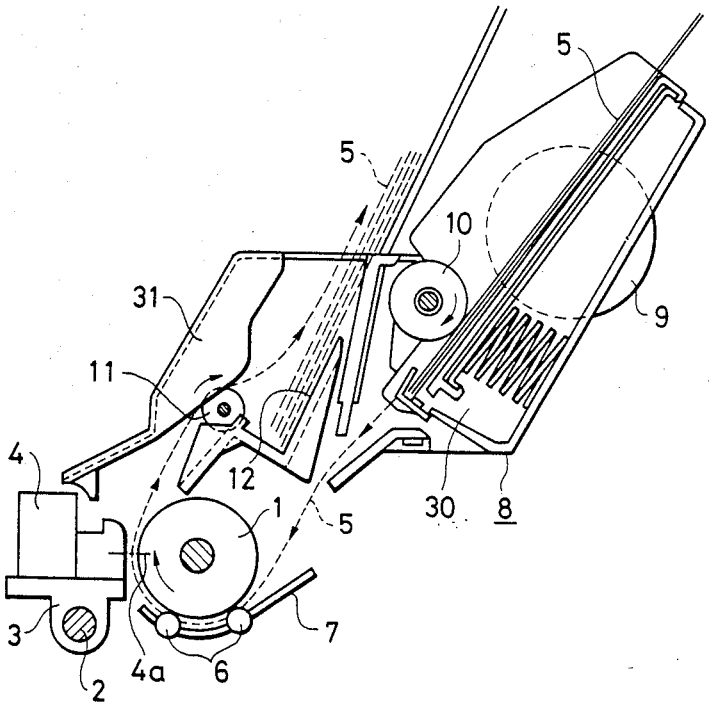
FIG. 1 is a longitudinal sectional view showing the main part of a recording system embodying the present invention.

FIG. 1 is a longitudinal sectional view showing the main part of a recording system according to a first embodiment of the present invention.

Referring to FIG. 1, a sheet feed roller 1 is rotatably supported in a recording apparatus such as a printer. A guide shaft 2 is mounted in front of the feed roller 1 and extends to be parallel thereto. A carriage 3 is movably arranged along the guide shaft 2. A recording head 4 is mounted on the carriage 3. The recording head 4 is driven in synchronism with movement (i.e., main scanning) of the carriage 3 to record information on a cut sheet 5 at a recording position 4*a*.

In the structure shown in FIG. 1, the sheet feed roller 1 also serves as a platen roller.

A pinch roller 6 for applying a feed force to the cut sheet 5 and a paper guide 7 are located to face the lower portion of the outer surface of the feed roller 1.

Arrows of broken lines in FIG. 1 indicate a feed path of the cut sheet 5.

A detachable cut sheet feed apparatus, i.e., a cut sheet feeder 8 is detachably mounted in the upper portion of the recording apparatus.

The cut sheet feeder 8 automatically feeds the cut sheets 5 in the recording apparatus one by one. In this case, the cut sheets 5 are stacked in a magazine 30 serving as a cut sheet storing means. The recorded sheets are automatically discharged outside the recording apparatus one by one. One drive motor 9 at the feeder side drives feed and discharge rollers 10 and 11 to achieve automatic feeding of the cut sheet toward the platen roller 1 and automatic discharge of the cut sheet toward a stacker 12 serving as a sheet storing means. Therefore, the cut sheet 5 discharged by the discharge roller 11 is stacked on the paper stacker 12. In this case, the cut sheet is fed while being clamped between the discharge roller 11 and guide ribs 31.

In the recording apparatus of FIG. 1, the feeder motor 9 consists of a reversible motor such as a pulse motor. The feed roller 10 is rotated only when the feeder motor 9 is rotated in the forward direction. The discharge roller 11 is rotated when the feeder motor 9 is rotated in either the forward or reverse direction.

A control system of the recording apparatus is operated as follows. When the sheet feed roller 1 is rotated in the forward direction, i.e., when the feeder motor (18 in FIG. 2) is rotated in the forward direction and the sheet feed roller 1 is rotated accordingly in the forward direction, the feeder motor 9 is rotated in the reverse direction.

A transmission system, i.e., a transmission system including a one-way clutch is arranged between the sheet feed roller 1 and the discharge roller 11. When the sheet feed roller 1 is manually rotated, the discharge roller 11 can be rotated accordingly. At the same time, the rotational force of the discharge roller 11 is substantially not transmitted to the sheet feed roller 1.

Figure 2:
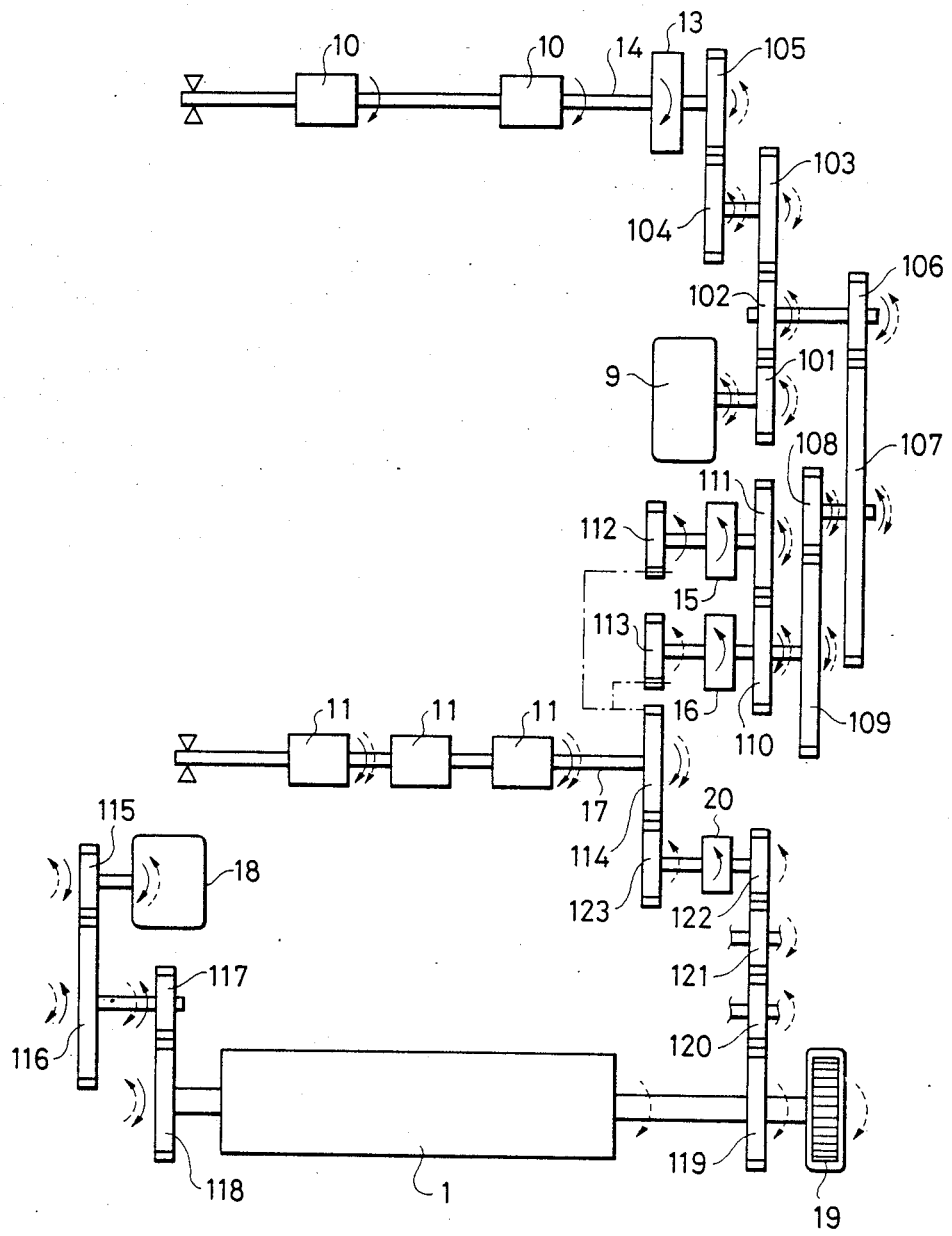
FIG. 2 is a schematic diagram of each roller drive system.

FIG. 2 is a schematic diagram showing the cut sheet feeder 8 and the drive system of the sheet feed roller 1 in the recording apparatus of FIG. 1.

An upwardly directed arrow in FIG. 2 represents counterclockwise rotation when viewed from the right side of FIG. 2, and a downwardly directed arrow represents clockwise rotation.

Referring to FIG. 2, when the feeder motor 9 is rotated in the forward direction, as indicated by the solid arrow, gears 101, 102, 103, 104, and 105 are rotated in directions indicated by solid arrows. The feed roller shaft 14 is rotated in the downward direction through a one-way clutch 13 for transmitting only a rotational force in the downward direction. The feed roller 10 is rotated in the sheet feed direction, and feeding of cut sheets 5 continues.

However, when the feeder motor 9 is rotated in the reverse direction, i.e., a direction indicated by the arrow of the broken line, the gears 101 to 105 are rotated in the direction of the arrows of broken lines. However, since the one-way clutch 13 is not operated, the feed roller 10 is substantially not rotated, and the sheet is not fed at all.

The feeder motor 9 is also used to rotate the discharge roller 11.

When the feeder motor 9 is rotated in the forward direction (i.e., an arrow of a solid line), a rotational force is transmitted from the gears 101 and 102 to gears 106, 107, 108, 109, 110, and 111 in solid line arrow directions. A gear 112 is rotated in the direction of the solid line arrow through a one-way clutch 15.

When the feeder motor 9 is rotated in the reverse direction, i.e., a direction indicated by an arrow of a broken line, the gears 101 and 102 allow rotation of the gears 106, 107, 108, 109, 110, and 111 in directions indicated by arrows of broken lines through a one-way clutch 16. In this case, the one-way clutch 15 is kept off, and the gear 112 is substantially not rotated.

The gears 112 and 113 are meshed with a gear 114 mounted on a discharge roller shaft 17. The rotational direction of the gear 112 upon driving of the feeder motor 9 in the forward direction is the same as that of the gear 113 upon driving of the feeder motor 9 in the reverse direction. Therefore, the discharge roller 11 can be rotated in the sheet discharge direction when the feeder motor 9 is rotated in the forward or reverse direction, thereby discharging the cut sheet 5.

The sheet feed roller 1 is driven by the feed motor 18 through gears 115, 116, 117, and 118. When the feed motor 18 is rotated in the forward direction (i.e., a direction indicated by an arrow of a solid line), the sheet feed roller 1 is rotated in the forward direction (i.e., a direction indicated by an arrow of a solid line). However, when the feed motor 18 is rotated in the reverse direction (i.e., a direction indicated by an arrow of a broken line), the sheet feed roller 1 is rotated in the reverse direction (i.e., a direction along which the sheet is fed to the inlet side).

A manual rotation knob 19 and a gear 119 are fixed to the shaft of the sheet feed roller 1, and a one-way transmission mechanism is arranged between the gear 119 and the gear 114 on the shaft 17 of the discharge roller 11.

When the knob 19 is manually rotated in a direction indicated by an arrow of a broken line to rotate the sheet feed roller 1 in the forward direction, gears 119, 120, 121, and 122 are rotated in directions indicated by arrows of broken lines. Therefore, the rotational force of the gear 122 is transmitted to a gear 123 through a one-way clutch 20.

The gear 123 is meshed with the gear 114 on the discharge roller shaft 17. Since the gear 123 is rotated in the upward direction, the discharge roller 11 is rotated in the discharge direction (the direction indicated by the downward arrow).

When the knob 19 is manually rotated in a direction opposite to the arrow of the broken line, the sheet feed roller 1 and the gears 119, 120, 121, and 122 are rotated in directions opposite to those described above. In this case, the one-way clutch 20 is turned off, and the gear 123 is substantially not rotated. Therefore, the discharge roller 11 is not rotated.

The rotational force (rotation in the direction indicated by the downward arrow) of the discharge motor 11 is transmitted to the gear 123. However, the one-way clutch 20 is turned off upon the above rotation and the rotational force is not further transmitted to the subsequent members. Therefore, the rotational force is not transmitted to the sheet feed roller 1. The rotational speed of the gear 123 is higher than that of the gear 122 so as to prevent interference between rotation of the discharge roller 11 and rotation of the sheet feed roller 1 at the time of automatic sheet feeding.

When the feeder motor 9 and the feed roller 18 are driven to rotate the discharge and feed rollers 11 and 1, a torque from the feeder motor 9 and a torque from the feed motor 18 are applied to the discharge roller 11. However, transmission of the torque from the feeder motor 9 through the one-way clutch 20 has a priority over that from the motor 18, thereby preventing mutual interference.

In this embodiment, the peripheral speed of the feed roller 10 is the same as that of the feed roller 1 in the sheet feed/discharge mode. The peripheral speed of the discharge roller 11 is higher than that of the feed roller 1 to keep the sheet taut. It should be noted that the effect of the present invention is not reduced even if the peripheral speed of the discharge roller 11 is equal to that of the feed roller 1.

As is described earlier, the peripheral speed of the gear 123 is lower than that of the gear 122 in the automatic sheet feed/discharge mode. Therefore, a ratio of the peripheral speed of the feed roller 1 to the peripheral speed of the discharge roller 11 in the automatic sheet feed mode differs from that in the manual sheet discharge mode.

According to the embodiment described above, when the feeder motor 9 is rotated in the reverse direction, only discharge operation is performed. However, when the feeder motor 9 is rotated in the forward direction, the feed roller 10 and the discharge roller 11 are simultaneously rotated. Feeding of the next cut sheet 5 need not be awaited in the continuous printing mode until the previous cut sheet 5 is completely discharged. Therefore, the throughput of recording can be greatly improved.

When the sheet feed roller 1 is manually rotated in the forward direction, the discharge roller 11 is also rotated. However, the rotational force of the discharge roller 11 is not transmitted to the sheet feed roller 1 since the transmission system including the one-way clutch 20 is arranged therebetween. Therefore, automatic sheet feeding and automatic sheet discharge by the cut sheet feeder 8 do not interfere each other. Manual sheet feeding or discharge can be performed, if desired. More specifically, if the operator wishes to arbitrarily adjust the printing position, if the power switch is turned off, or if an alarm is generated by paper jam or the like, the cut sheet 5 can be manually fed or discharged, as needed. Therefore, flexibility and handling efficiency of the recording apparatus can be greatly improved.

Figure 3:
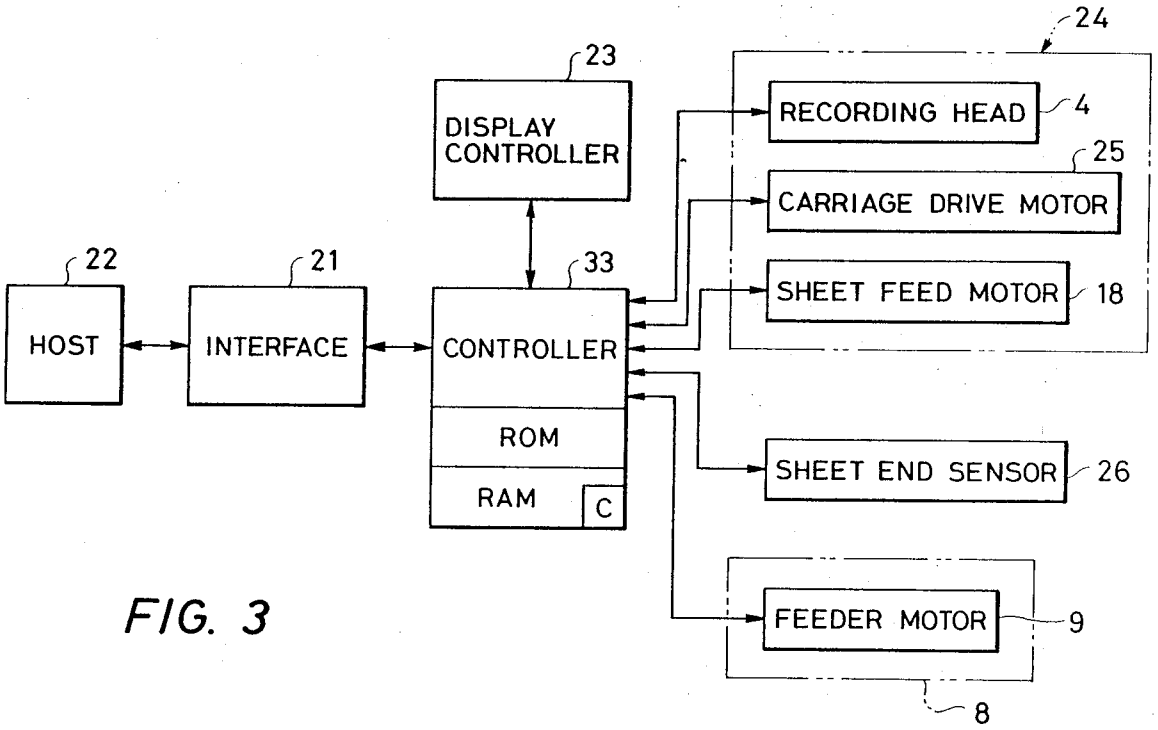
FIG. 3 is a block diagram of a control system for suitably practicing the embodiment of the present invention.

FIG. 3 is a block diagram of a control system of the recording system described above.

Referring to FIG. 3, a controller 33 in the recording apparatus is connected to a host machine 22 such as a computer through an interface 21. Various command signals and printing data signals are input to the recording apparatus.

The controller 33 is connected to a display controller 23.

The controller 33 controls the operation of the recording apparatus and the operation of the cut sheet feeder 8. The controller 33 controls the operation of the recording head 4 constituting a recording unit 24, a carriage drive motor 25, the feed motor 18 (FIG. 2), and the feeder motor 9 in the cut sheet feeder 8. A sheet end sensor 26 is arranged in the sheet feed unit in the recording apparatus to detect the presence/absence of the sheet 5 and send a detection signal to the controller 33. When the sheet end sensor 26 detects the presence of a sheet, the controller 33 determines that the manual feed mode is set. However, when the sheet end sensor 26 detects the absence of a sheet, the controller 33 determines that the automatic sheet feed mode is set, i.e., that the cut sheet feeder 8 is actuated in response to the printed data input.

According to this embodiment, in the cut sheet feeder 8, when printing instructions are generated during the discharge of the sheet 5, or when the cut sheet feed instructions for designating continuous feeding of the sheets are generated, the next sheet is fed upon completion of the discharge of the sheet.

When one-page printing is completed, the feeder motor 9 is rotated in the reverse direction to drive the discharge roller 11 and hence to discharge the sheet 5. During this operation, when printing data is input, the feeder motor 9 is immediately switched and rotated in the forward direction. The discharge roller 11 is continuously driven. At the same time, the feed roller 10 is driven to feed the next sheet 5 to the feed roller 1.

Figure 4:
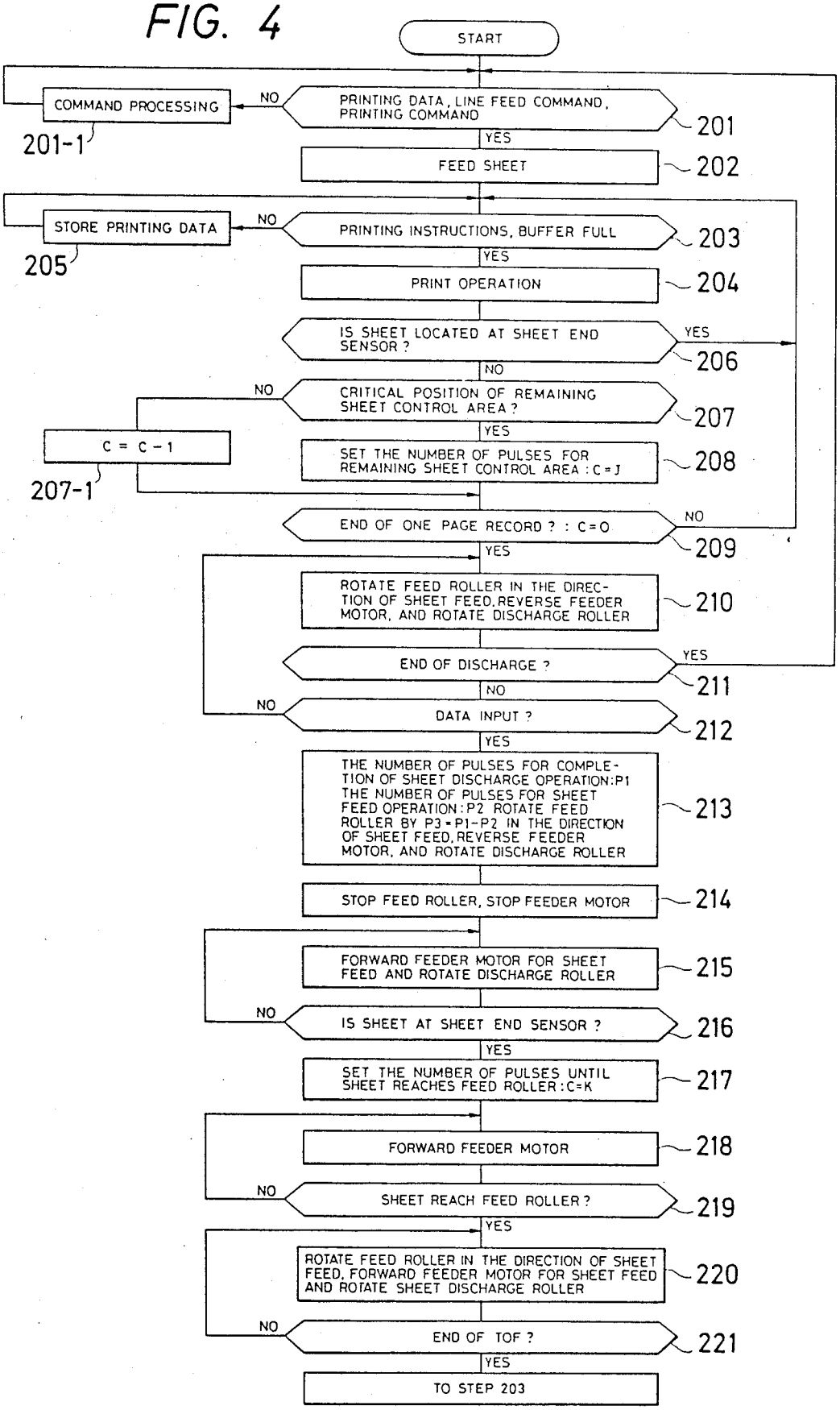
FIG. 4 is a flow chart showing the operation sequence of the embodiment.

FIG. 4 is a flow chart showing the operation sequence of the controller. The operation sequence is stored in a ROM in the controller 33.

Referring to FIG. 4, when the recording apparatus is turned on and started, the controller 33 determines in step 201 whether information required for recording, such as printing data, a line feed command, and a printing command is present. If YES in step 201, the flow advances to step 202, and the feeder motor 9 is rotated in the forward direction to feed the sheet.

When sheet feeding is completed, the flow advances to step 203. The controller 33 determines in step 203 whether the printing instructions are output to the recording apparatus and whether a buffer memory is full of printing data or the like.

If the controller 33 determines that the printing instructions are output and the buffer is full, the flow advances to step 204, and printing (including sheet feeding of the feed roller 1) is performed. Otherwise, the flow advances to step 205. In step 205, the printing data is stored in the buffer, and the flow returns to step 203.

The controller 33 determines in step 206 whether the sheet end sensor 26 detects the presence/absence of a sheet, and if YES in step 206, the flow returns to step 203.

The controller 33 determines in step 207 the significance of sheet absence detected by the sheet end sensor 26. In this embodiment, a proper margin is left at the trailing end of the sheet to constitute such an area as a remaining sheet control area, thereby controlling the trailing end of the sheet. The remaining sheet control area extends from a critical position where the sheet end sensor 26 begins to detect the absence of sheet and to a designated margin start position. The controller 33 determines in step 207 whether the position is the critical position of the remaining sheet control area. If YES in step 207 (i.e., the sheet end sensor 26 detects the absence of sheet for the first time), the number of pulses for the remaining sheet control area is set in a counter C in the RAM in the controller 33 (C=J).

However, if NO in step 207, the count of the counter C is decremented by one in step 207-1, and the flow advances to step 209.

The controller 33 determines in step 209 whether condition C=0 is established, i.e., whether one-page recording is completed. If NO in step 209, the flow returns to step 203. If YES in step 207, the flow jumps to step 209. If YES in step 209, i.e., if the controller 33 determines that one-page recording has been completed, the flow advances to step 210. In this step, the feed roller 1 is rotated in the sheet feed direction, and discharge operation for rotating the discharge roller 11 is started.

When sheet discharge operation is initiated, the flow advances to step 211 to determine whether sheet discharge has been completed. If YES in step 211, the flow returns to step 201 again. However, if NO in step 211, the flow advances to step 212 to determine whether printing data is input.

If YES in step 212, i.e., if continuous cut sheet feeding is to be performed, the flow advances to step 213 to control rotation of the feed roller 1 and rotation of the discharge roller 11. The discharge operation of the cut sheet feeder 8 is started.

In the initial discharge operation, if the number of pulses of the feeder motor 9, which is required for completion of sheet discharge is P1, and the number of pulses required for sheet feeding is P2, the feed motor 18 is driven by a difference P3 (=P1−P2) to feed the platen 1 in the sheet feed direction. At the same time, the feeder motor 9 is rotated in the reverse direction to rotate the discharge roller 11.

When the initial discharge period counted by the number P3 of pulses in step 213 has elapsed, the flow advances to step 214. The feed roller 1 (the feed motor 18) and the feeder motor 9 are stopped.

In step 215, the feeder motor 9 is rotated in the forward direction to feed the cut sheet (i.e., driving of the feed roller 10), and at the same time, rotation of the discharge roller 11 allows remaining discharge operation.

Upon initialization of the above feeding, the controller 33 determines in steps 216 to 219 whether the sheet has reached the feed roller. If NO in step 219, the flow advances to step 220. In step 220, the feed motor 18 is driven to rotate the feed roller 1 in the sheet feed direction. At the same time, the feeder motor 9 is rotated in the forward direction to complete the remaining paper feed and discharge operations. In step 221, the controller 33 determines whether TOF is completed, that is, whether the feed of the cut sheet to the recording start position is completed.

If YES in step 221, the flow returns to step 203, and recording is started while the controller 33 controls the recording unit 24 including the recording head 4, the carriage drive motor 25, and the feed motor 18.

As is apparent from the above description, when the cut sheets are continuously fed, special operations in steps 211 to 221 must be performed. This operation sequence can be described from another viewpoint as follows.

The discharge operation of the leading cut sheet and the feed operation of the trailing or a new cut sheet (i.e., the TOF of the cut sheet, or feed operation of the cut sheet to the recording start position) are simultaneously performed. The controller 33 controls so that at least the discharge operation is completed when feeding is completed.

If the control sequence is expressed from still another viewpoint, when the trailing end of the leading cut sheet is released from the feed roller, the feed roller 1 is stopped. However, the feed roller 10 and the discharge roller 11 are operated to simultaneously perform feeding and discharge. When the trailing cut sheet reaches the feed roller 1 and is aligned thereat, the feed roller 1 is also rotated to perform TOF of the trailing cut sheet.

The present invention is not limited to the particular embodiment described above. For example, the present invention is also applicable to a recording apparatus to which a cut sheet feeder is permanently attached.

What is claimed is:

1. A cut sheet feed apparatus in a recording system having recording means for performing recording at a recording position, including:

first storing means for storing cut sheets to be fed to the recording position;

supplying means for supplying the cut sheets from said first storing means to the recording position;

second storing means for storing cut sheets passing through the recording position;

discharge means for discharging the cut sheets to said second storing means;

a reversible drive motor for operating said supplying means and said discharge means; and transmitting means for transmitting a forward rotational force of said drive motor to said supplying means and said discharge means to simultaneously perform supply and discharge operations, and for transmitting a reverse rotational force to said discharge means to release transmission of the rotational force to said supplying means, thereby allowing only the discharge operation.

2. An apparatus according to claim 1, wherein said supplying means includes a supply roller, and said discharge means includes a discharge roller.

3. An apparatus according to claim 2, wherein said discharge means further comprises guide ribs, said guide ribs being adapted to cooperate with said discharge roller to clamp and discharge the cut sheet.

4. An apparatus according to claim 1, further comprising a feed roller for feeding the cut sheet from said supplying means to the recording position and further to said discharge means, said feed roller being independently driven by another motor arranged separately from said drive motor.

5. An apparatus according to claim 4, wherein said feed roller comprises a platen roller for causing the cut sheet wound therearound to face the recording position.

6. An apparatus according to claim 4, further comprising an operation member for allowing manual rotation of said feed roller, and another transmitting means for transmiting a rotational force of said feed roller to said discharge means to perform discharge when said operation member is operated to rotate said feed roller.

7. An apparaus according to claim 6, wherein said another transmitting means includes a one-way clutch for transmitting the rotational force from said feed roller to said discharge means and for inhibiting transmission of power of said discharge means to said feed roller.

8. An apparatus according to claim 7, wherein the transmission of the power to said discharge means by said transmitting means has a higher priority than that by said another transmitting means.

9. An apparatus according to claim 7, wherein said one-way clutch transmits a rotational force in a supply direction of said supply roller but inhibits transmission of a rotational force in a direction opposite to the supply direction.

10. A cut sheet feed apparatus in a recording system having recording means for performing recording at a recording position, including;

feed means for feeding a cut sheet so as to cause the cut sheet to pass by the recording position by a feed motor;

storing means for storing the cut sheet passing by the recording position;

discharge means for discharging the cut sheet passing by the recording position into said storing means;

a drive motor for driving said discharge means;

operating means for manually operating said feed means; and one-way transmitting means for transmitting power of said feeding means to said discharge means and for substantially inhibiting transmission of power of said discharge means to said feeding means.

11. An apparatus according to claim 10, wherein said feeding means comprises a feed roller, and said discharge means comprises a discharge roller.

12. An apparatus according to claim 11, wherein said feed roller has a peripheral speed lower than that of said discharge roller.

13. An apparatus according to claim 11, a ratio of the peripheral speed of said feed roller to that of said discharge roller upon driving of said drive motor and said feed motor being different from that upon stopping of said drive motor and said feed motor and operation of said operating means.

14. A cut sheet feed apparatus in a recording system having recording means for performing recording at a recording position, including:

first storing means for storing a cut sheet to be fed to the recording position;

supplying means for supplying the cut sheet from said first storing means;

a feeding roller for causing the cut sheet fed from said supplying means to pass by the recording position;

second storing means for storing the cut sheet passing by the recording position;

discharge means for discharging the cut sheet fed from said feeding roller into said second storing means; and means for controlling operations of said supplying means, said feeding roller, and said discharge means, said supplying means and said discharge means being simultaneously operated when said feeding roller is stopped, whereby an old cut sheet may be discharged to said second storing means and a new cut sheet transported from said first storing means to reach the stopped feeding roller.

15. An apparatus according to claim 14, wherein said control means controls to cause said feeding roller to operate after the cut sheet from said first storing means reaches said feeding roller.

16. An apparatus according to claim 14, wherein said supplying means includes a supply roller and said discharge means includes a discharge roller.

17. An apparatus according to claim 14, further comprising a reversible drive motor for driving said supplying means and said discharge means when said reversible drive motor is driven in a forward direction, and for driving said discharge means and inhibiting driving of said supplying means when said reversible drive motor is rotated in a reverse direction.

18. An apparatus according to claim 17, further comprising another motor arranged independently of said reversible drive motor to drive said feed roller.

19. A cut sheet feed apparatus in a recording system having recording means for performing recording at a recording position, including:

first storing means for storing a cut sheet to be fed to the recording position;

supplying means for supplying the cut sheet from said first storing means;

a feeding roller for causing the cut sheet fed from said supplying means to pass by the recording position;

second storing means for storing the cut sheet passing by the recording position;

discharge means for discharging the cut sheet fed from said feeding roller in said second storing means; and control means for controlling said supplying means, said feeding roller, and said discharge means, said control means being adapted to, when a trailing end of a leading cut sheet is released from said feeding roller, stop said feeding roller and for simultaneously operating said supplying means and said discharge means, thereby simultaneously performing supply and discharge operations.

20. An apparatus according to claim 19, wherein said supplying means includes a supply roller, and said discharge means includes a discharge roller.

21. An apparatus according to claim 19, further comprising a reversible drive motor for driving said supplying means and said discharge means in a forward rotational direction and for driving said discharge means and inhibiting driving of said supplying means in a reverse rotational direction.

22. An apparatus according to claim 21, further comprising another motor arranged independently of said reversible drive motor to operate said feeding roller.

* * * * *

UNITED STATES PATENT AND TRADEMARK OFFICE

CERTIFICATE OF CORRECTION

PATENT NO. : 4,789,259

DATED : December 6, 1988

INVENTOR(S) : JUN KATAYANAGI

It is certified that error appears in the above-identified patent and that said Letters Patent is hereby corrected as shown below:

Cover Page,

Item [30], line 3, "61-8997" should read --61-88997--;

Abstract, line 9, "means" should read --means,--.

Column 4, line 16, "motor" should read --roller--;

line 26, "roller" should read --motor--;

line 66, "each" should read --with each--.

Signed and Sealed this

Twenty-eighth Day of March, 1989

*Attest:*

DONALD J. QUIGG

*Attesting Officer*

*Commissioner of Patents and Trademarks*